US007495447B2

(12) United States Patent
Alger, II et al.

(10) Patent No.: US 7,495,447 B2
(45) Date of Patent: Feb. 24, 2009

(54) BENCHTOP TEST SYSTEM FOR TESTING SPARK PLUG DURABILITY

(75) Inventors: Terrence Francis Alger, II, San Antonio, TX (US); Darius Mehta, San Antonio, TX (US); Charles Edward Roberts, Jr., San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/513,547

(22) Filed: Aug. 31, 2006

(65) Prior Publication Data

US 2007/0096742 A1 May 3, 2007

Related U.S. Application Data

(60) Provisional application No. 60/713,467, filed on Sep. 1, 2005.

(51) Int. Cl.
*F02P 17/00* (2006.01)

(52) U.S. Cl. ..... 324/401; 324/383; 324/400

(58) Field of Classification Search ..... 324/393, 324/399, 400

See application file for complete search history.

(56) References Cited

U.S. PATENT DOCUMENTS 1,680,334 A 8/1928 Lewis et al.
1,834,990 A 12/1931 Zeller
2,295,453 A * 9/1942 Denison, Jr. ..... 324/401
2,324,458 A * 7/1943 Peters et al. ..... 324/394
2,505,422 A * 4/1950 Michaels ..... 451/77
2,629,001 A 2/1953 Peters ..... 175/183
2,801,384 A * 7/1957 Pierce ..... 324/401
2,836,058 A 5/1958 Oden et al. ..... 73/40
2,892,149 A * 6/1959 Persak, Jr. ..... 324/401
2,899,634 A * 8/1959 Carbonneau ..... 324/401
3,002,819 A * 10/1961 Brace et al. ..... 422/78
3,330,718 A 7/1967 James et al. ..... 156/554
4,032,842 A 6/1977 Green et al. ..... 324/15
5,197,448 A * 3/1993 Porreca et al. ..... 123/620
5,321,978 A * 6/1994 Brandt et al. ..... 73/116
5,777,216 A * 7/1998 Van Duyne et al. ..... 73/116

OTHER PUBLICATIONS

PCT International Search Report and Written Opinion, PCT/US06/34045, 11 pages, Jan. 11, 2008.

* cited by examiner

*Primary Examiner*—Vincent Q. Nguyen
*Assistant Examiner*—Thomas Valone
(74) *Attorney, Agent, or Firm*—Baker Botts LLP

(57) ABSTRACT

A method and system for evaluating the durability of spark plugs. A test system simulates the pressure, temperature, and exhaust flow of an internal combustion engine, and has a test chamber in which these simulated conditions exist. A number of spark plugs are installed in the test chamber and are cycled through a desired ignition cycle. The test chamber temperature and pressure may be precisely controlled, as well as the duty cycle of spark events.

24 Claims, 3 Drawing Sheets

BENCHTOP TEST SYSTEM FOR TESTING SPARK PLUG DURABILITY

RELATED PATENT APPLICATION

This application claims the benefit of U.S. Provisional Application No. 60/713,467, filed Sep. 1, 2005 and entitled "Benchtop Test System For Testing Spark Plug Durability."

TECHNICAL FIELD OF THE INVENTION

This invention relates to internal combustion engines, and more particularly to, testing spark plugs used with such engines.

BACKGROUND OF THE INVENTION

In an internal combustion engine, the "ignition system" is the mechanism that ignites the fuel consumed by the engine. Most engines use either an electrical spark or a compression heating ignition system. Typical electrical spark ignition systems rely on a battery, an induction coil, and a spark igniter to provide an electrical spark to ignite the air-fuel mix in the engine's cylinders. Compression heating ignition systems inject fuel into the engine's cylinders and rely on the heat created in the air by compression in the cylinders to ignite the fuel.

In the case of electrical spark ignition systems, the spark igniter is typically a spark plug having electrodes that extend into the combustion chamber. The plug provides a spark and a gap for that spark to jump across. The plug also conducts heat from the combustion process to the cylinder head and into the cooling system.

To meet these performance requirements and to provide long life and superior engine performance, a large amount of technology goes into the design and manufacture of spark plugs. The spark plug manufacturing industry is particularly interested in developing spark plugs that last for longer periods of time.

Currently there is no standard for spark plug durability, Society of Automotive Engineers (SAE) or otherwise. Thus, different manufacturers develop their own standards and tests. For example, many manufacturers have a self-imposed requirement that a spark plug be capable of performing in an automotive engine for at least 100,000 miles before a plug change or tune up is required.

Conventional spark plug testing is achieved by using the spark plugs in a real engine. A typical spark plug test consists of 400 to 500 hours of engine testing running a specified test cycle. An example of a test cycle is 30 seconds at full load followed by 30 seconds at idle, repeated for the test duration. Continuous full load testing is not feasible because of engine durability issues. This method of testing is also expensive because it requires an engine, a dynamometer, and large amounts of fuel.

DETAILED DESCRIPTION OF THE INVENTION

The following description is directed to a system and method for durability testing of spark plugs. The system simulates the adverse conditions to which spark plugs are exposed in a running engine, but eliminates the time and costs associated with operating an actual engine. The system provides "accelerated" testing in the sense that spark plugs can be aged as they would be aged in an engine, but in a substantially shorter amount of time.

Figure 1:
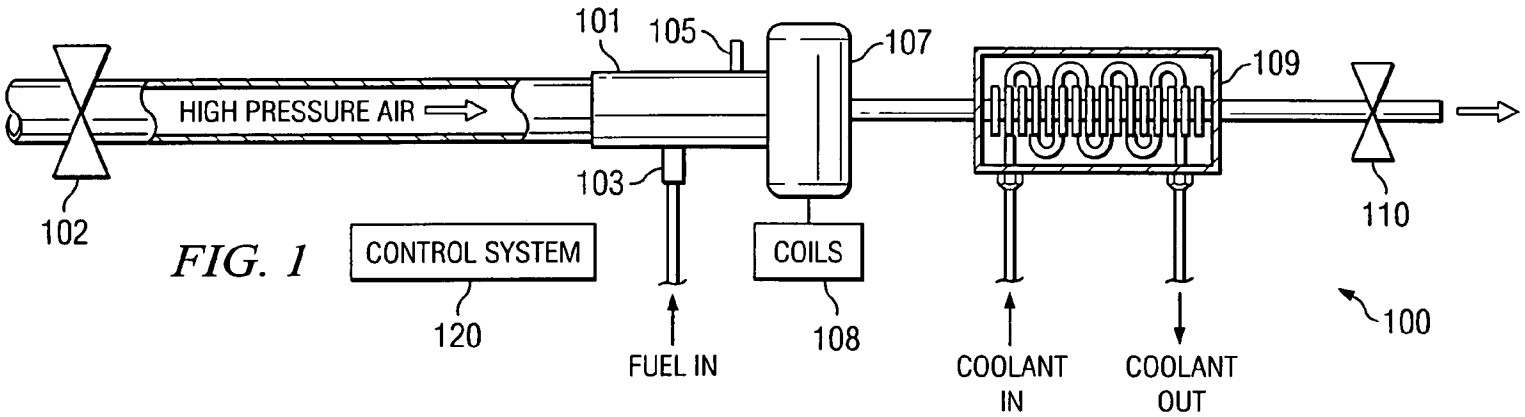
FIG. 1 illustrates a spark plug durability testing system in accordance with the invention.

FIG. 1 illustrates a spark plug test system 100 in accordance with the invention. System 100 comprises a burner 101, test chamber 107, heat exchanger 109, and relief valve 110, installed in that order along a flow line, with each of these components being in fluid communication with the next.

Burner 101 is essentially a fuel combustion chamber that provides exhaust simulating that of a fuel-burning engine. Burner 101 receives pressurized input air via an air intake port, with the air input being controlled by intake valve 102. A fuel injector 103 is used to inject fuel into the burner 101. A mixture of fuel and air is ignited by an igniter 105 that extends into burner 101.

Burner 101 burns gasoline or any other fuel appropriate for an internal combustion engine. It provides burned gas and air, as an exhaust flow into chamber 107.

Burner 101 may be spark ignited or pilot ignited. The input fuel and air may be adjusted to result in rich, lean, or stoichiometric combustion. The exhaust from burner 101 and into chamber 107 will reflect the type of combustion.

Burner 101 provides hot burnt gases to simulate the effects of combustion and to achieve the temperatures found in an engine operating at a specified load. The use of a fuel burner 101 ensures that spark plugs within test chamber 107 are exposed to engine-like combustion gases, which may contain water, reactive chemicals, and other contaminants.

Various alternative designs of burner 101 are possible. The burner design can reflect various engine designs, such as by using pre-combustion chambers, different types of injectors, and the like.

Test chamber 107 is an enclosure for holding a number of spark plugs. It has a number of spark plug slots for inserting the spark plugs, such that the spark plug electrodes extend into the chamber similar to the manner in which they would extend into a combustion chamber such as an engine cylinder. Test chamber 107 is sealable, so as to be capable of providing a pressurized volume for running the spark plugs at ignition pressures.

Figure 2:
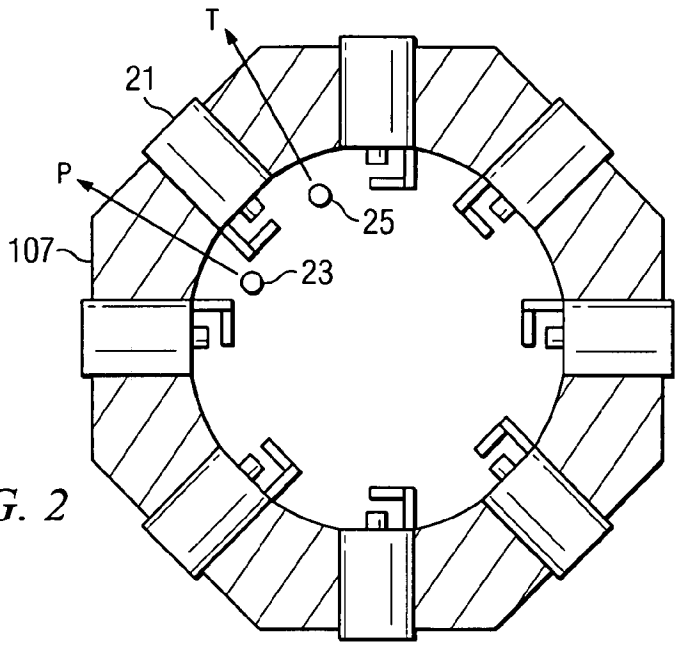
FIG. 2 illustrates the test chamber of FIG. 1 in further detail.

FIG. 2 is a cross sectional view of test chamber 107. In the example of FIG. 2, test chamber 107 holds one row of eight spark plugs 21. However, more or fewer spark plugs may be installed. Any unused openings may be closed.

Chamber 107 is essentially a hollow tube made from a material having high thermal conductivity, such as steel or aluminum. In the example of this description, chamber 107 is installed at an open end of burner 101, but any form of fluid connection may be used.

Temperature (T) and pressure (P) sensors 23 and 25 may be installed within chamber 107. Measurement signals from these sensors may be for test monitoring. As explained below, control unit 120 may be used to acquire data from these sensors and evaluate the testing process.

In the example of FIG. 2, test chamber 107 is cylindrical, but various other geometries are possible. Furthermore, in this example, test chamber 107 exposes each spark plug 21 to the same exhaust gas amounts and temperature, but other configurations are possible.

Referring again to FIG. 1, coils 108 provide an electrical signal to each of the spark plugs in chamber 107 so as to produce a spark across the spark plug electrodes. As explained below, coils 108 may receive control signals from a control unit 120.

The gas from test chamber 107 is exhausted into the flow line, and passed through heat exchanger 109. Heat exchanger 108 cools the exhaust by using a coolant flow passageway around the exhaust flow line. Heat exchanger 109 receives coolant, circulates the coolant, and discharges the coolant to waste.

Relief valve 110 is placed downstream of test chamber 107. It is adjustable to control the pressure inside chamber 107. In the example of this description, relief valve 110 is placed along an exhaust flow line leading from test chamber 107, which accommodates the installation of heat exchanger 109. However, it is also possible to install the relief valve directly into test chamber 107.

As an example of operation of system 100, the duty cycle of the spark plugs, as well as the period and amplitude of temperature and pressure changes within test chamber 107, can be adjusted to simulate different engine operating conditions. More specifically, injector 103 may be operated on a duty cycle to provide a quasi-steady flow of hot gases to the test chamber 107. This duty cycle is adjusted to achieve a target temperature in the test chamber 107. The target temperature can be altered to simulate different load conditions, with higher temperatures simulating high loads and lower temperatures simulating idle or low loads. Pressure valve 110 is also adjusted to simulate load changes. The coils 108 can operate at varied dwell times on different duty cycles.

The above-described test procedures can be automated using a control system 120, which receives input from various sensors associated with system 100 and delivers control signals to its various actuators. Control unit 120 may be implemented with conventional computing equipment, including processors and memory. It is equipped with suitable input devices, a monitor, and a multi-function data acquisition card, connected to an digital relay module to monitor and record system information, and to control system electronics.

Control unit 120 is programmed to run various simulation programs. Control unit 120 is electrically connected to the various actuators discussed above, such as injectors, heaters, coolers, and relief valve.

More specifically, control unit 120 can be programmed to control the pressure within chamber 107 by means of valves 102 and 110. It controls fuel injector 103, thereby controlling temperature by controlling the amount of fuel ignited and burned, as affected by air flow into burner 101. That is, temperature in chamber 107 is a function of both a specific air flow rate and an amount of injected fuel. As described below in connection with FIG. 4, temperature can also be controlled by heating or cooling chamber 107 using an external heater or cooler.

Temperature and pressure may be controlled and cycled independently of each other and may be cycled rapidly. Any factor affecting spark plug durability may be introduced, and the time and magnitude of exposure to that factor may be precisely controlled.

After a test cycle is run, spark plugs 21 are removed from test chamber 107. They may then be evaluated, and in particular, their durability characteristics recorded. If desired, spark plugs may be "aged" using system 100, and then tested with real engines.

Figure 3:
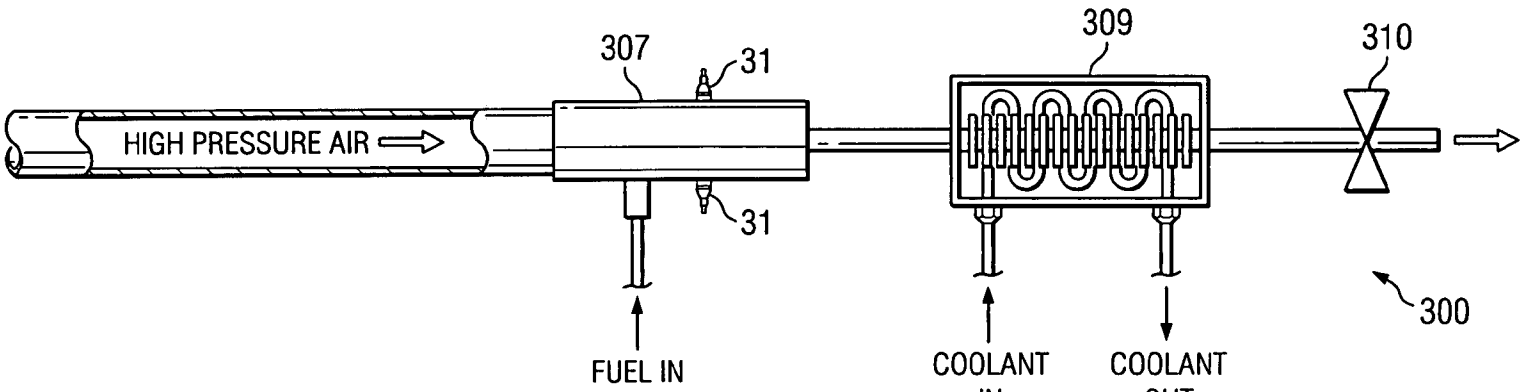
FIG. 3 illustrates an alternative embodiment of the testing system.

FIG. 3 illustrates an alternative embodiment, a system 200 in which a separate igniter 105 is not used. Instead, burner 101 and test chamber 107 are integrated, such that fuel and air are injected into chamber 107 or into a pre-chamber directly upstream of chamber 107. The spark plugs 21 within test chamber 307 are used to ignite the air-fuel mixture.

Figure 4:
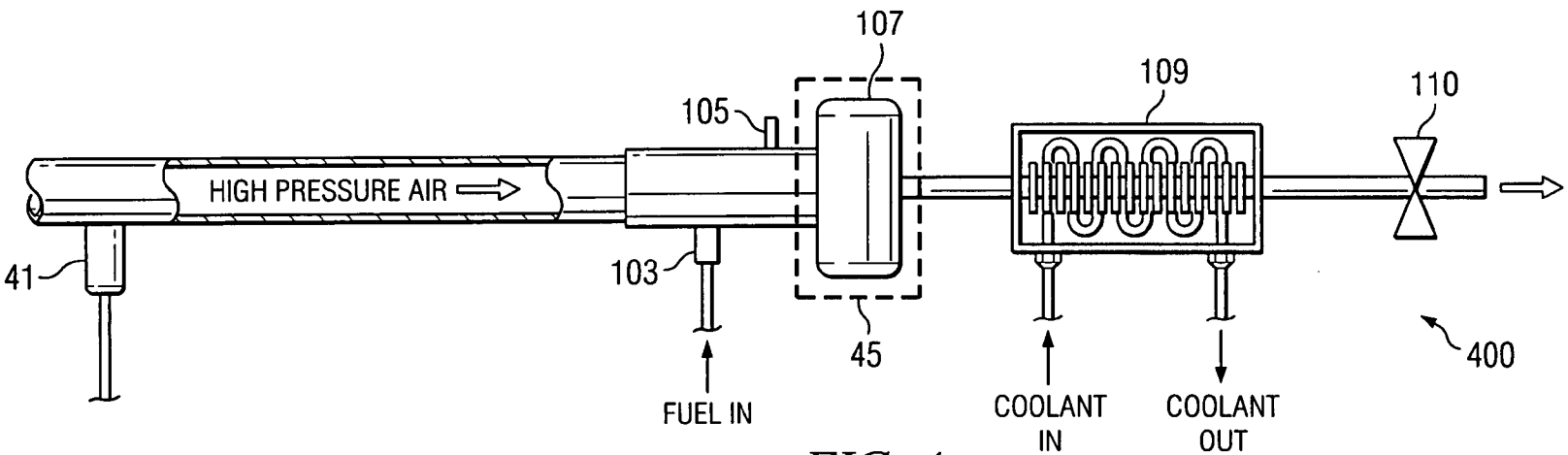
FIG. 4 illustrates the testing system of FIG. 1, modified to include an oil injector and a thermal control unit.

FIG. 4 illustrates an alternative embodiment in which system 100 is modified to include an oil injector 41 which injects oil into the input air flow. Typically, the injected oil is a lubricating oil to simulate the effects of oil consumption by the engine. Various fuel and oil additives may also be injected and their effects on spark plugs 21 evaluated.

FIG. 4 further illustrates a temperature controlled system 400, having a temperature control unit 45, which may be used to heat or cool test chamber 107 to a desired temperature. For example, it may be desired to maintain chamber 107 at a temperature found in the combustion chamber of an actual engine under specified operating conditions. Some heat may be provided by combustion within burner 101, and ambient heating or cooling may be provided by temperature control unit 107.

In the example of FIG. 4, temperature control unit 107 is implemented as a jacket-type device 45 surrounding test chamber 107. Other types of temperature control units could be used, provided that they are in thermal communication with test chamber 107.

Referring again to FIG. 2, temperature sensor 25 may be used as part of a control system to control the temperature within chamber 107. The location of sensor 25 within chamber 107 may be varied, and more than one temperature sensor 25 may be used. For example, it might be desired to measure and control the temperature at the tip of one or more of the plugs 21. Control unit 120 is appropriately programmed to receive temperature parameters, to execute appropriate control algorithms, and to deliver signals to one or more actuators or temperature control devices, such as the valves, the injector, heat exchanger, or temperature control unit of the systems described herein.

Figure 5:
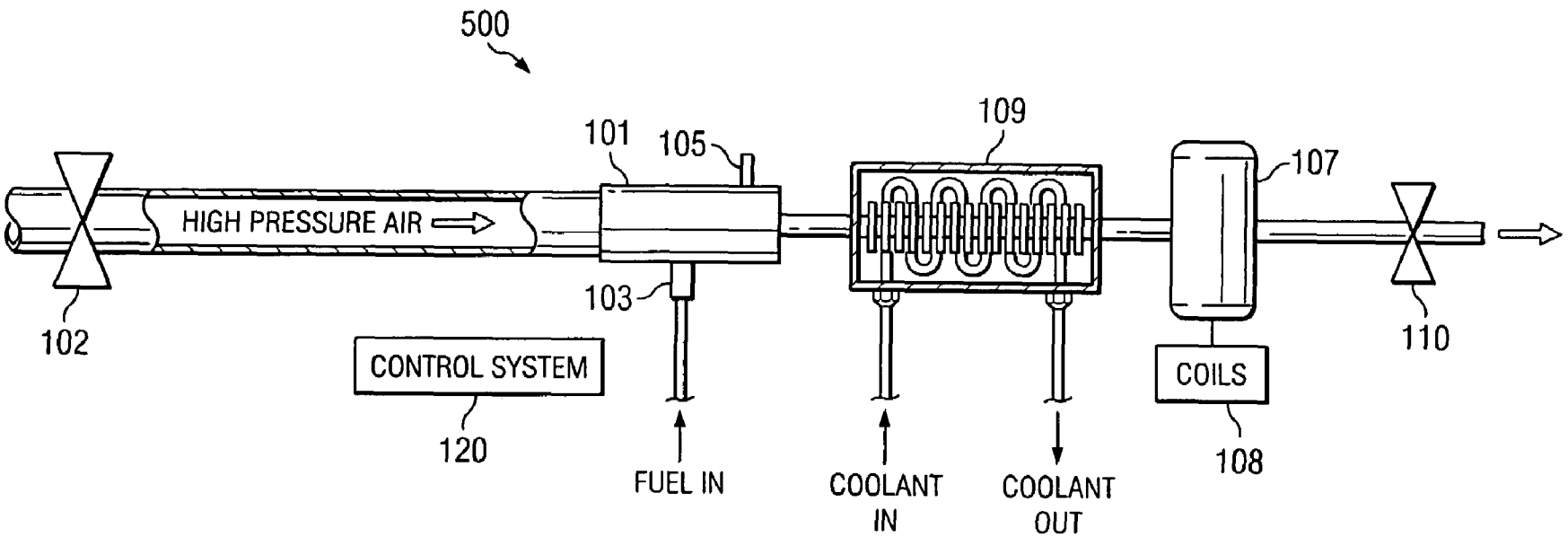
FIG. 5 illustrates an alternative embodiment of the testing system.

As illustrated in FIG. 5, another modification the systems of FIG. 1, 2, or 3 is relocation of the heat exchanger 109 to some other position on the flow line. In one embodiment, the heat exchanger is placed between the burner 101 and the test chamber 107. This results in a decoupling of the pressure and temperature parameters within test chamber 107 from the exhaust composition and conditions.

An advantage of system 100 is that spark plug testing is not constrained by factors such as engine friction and durability. The system can generate sparks at a much higher rate than systems that rely on a real engine. For example, system 100 is expected to achieve spark rates of at least 100 Hz (one spark event every 10 ms). At this rate, system 100 can generate 45 million sparks in 125 hours. This is one-quarter the time required for engine-based testing, at an average engine speed of 3000 rpm.

System 100 substantially reduces the time and expense of spark plug durability testing. It can be implemented as a compact benchtop system, and will permit more spark plugs to be tested in a shorter time, as compared to engine-based test systems.

The invention claimed is:

1. A system for testing spark plug durability, comprising:

a burner for combusting air and fuel, thereby providing exhaust gas, the burner having a burner tube with a first end for receiving high pressure air input and a second end for outputting the exhaust gas, and the burner further having a fuel injector for injecting the fuel into the burner tube and an igniter for igniting the fuel;

a test chamber downstream of and external to the burner, and in fluid communication with the second end of the burner such that it receives the exhaust gas;

wherein the test chamber has a plurality of openings, each opening for receiving a spark plug, such that at least the spark plug electrodes extend into the interior of the test chamber;

wherein the openings are arranged relative to the interior of the test chamber, such that each spark plug's electrodes are exposed to substantially the same exhaust gas amount and temperature; and an exhaust flow line for exhausting gas from the test chamber.

2. The system of claim 1, wherein the burner is ignited with a spark igniter separate from the spark plugs.

3. The system of claim 1, wherein the burner is ignited with a pilot igniter.

4. The system of claim 1, further comprising a heat exchanger downstream the test chamber.

5. The system of claim 1, further comprising a heat exchanger between the burner and the test chamber.

6. The system of claim 1, further comprising a temperature control unit in thermal communication with the test chamber.

7. The system of claim 1, further comprising a control unit programmed to perform a spark plug test cycle, wherein the control unit is in electrical communication with the burner, the test chamber, and the valve.

8. The system of claim 1, wherein the control unit controls the temperature and pressure within the test chamber, and the duty cycle of electrical signals applied to the spark plugs.

9. The system of claim 1, further comprising a relief valve for controlling the pressure within the test chamber by controlling the exhaust flow from the chamber.

10. The system of claim 1, further comprising an intake valve that controls the flow of air into the burner.

11. The system of claim 1, wherein the system is operable to provide spark events at a rate of at least 100 Hz.

12. The system of claim 1, wherein the test chamber is sealable so that it may be pressurized by the flow exhaust gas into the test chamber.

13. The system of claim 1, wherein the test chamber has a cylindrical internal geometry, with the cylindrical axis parallel to the exhaust glow through the test chamber, and wherein the openings are arranged in a circular pattern around the inner diameter of the test chamber.

14. The system of claim 1, further comprising an oil injector for injecting engine lubricants or additives into the input air.

15. A method of testing spark plugs, comprising:

providing a burner for combusting air and fuel, thereby providing exhaust gas, the burner having a burner tube with a first end for receiving high pressure air input and a second end for outputting the exhaust gas, and the burner further having a fuel injector for injecting the fuel into the burner tube and an igniter for igniting the fuel;

providing a spark plug test chamber downstream of and external to the burner, the chamber having a plurality of openings, each opening for receiving a spark plug such that at least the electrodes of the spark plug extend into the interior of the chamber;

wherein the spark plugs are arranged relative to the interior of the test chamber, such that each spark plug is exposed to the same exhaust gas amount and temperature;

controlling pressure within the chamber;

controlling temperature within the chamber;

providing exhaust from fuel combustion into the chamber;

applying an electrical signal to the spark plugs thereby causing them to spark;

repeating the applying step at a controlled rate for a controlled duration of time; and exhausting the exhaust from the chamber.

16. The method of claim 15, wherein the combusting step is performed by using a fuel burner in fluid communication with the test chamber such that the exhaust flows from the burner into the test chamber.

17. The method of claim 15, wherein the combusting step is performed by using at least one of the spark plugs to ignite the fuel.

18. The method of claim 15, wherein the step of controlling pressure is performed using a relief valve that controls the exhausting step.

19. The method of claim 15, wherein the step of controlling temperature is at least partly performed by controlling the combusting step.

20. The method of claim 15, wherein the step of controlling temperature is at least partly performed by using a temperature control unit in thermal communication with the test chamber.

21. The method of claim 15, wherein the controlling step is performed by measuring temperature at the tip of one or more of the spark plugs.

22. The method of claim 15, further comprising controlling the duty cycle of the spark plug ignition.

23. The method of claim 15, further comprising the step of removing and evaluating the spark plugs.

24. The method of claim 15, further comprising the step of injecting an engine lubricant or additive into the air input.

* * * * *